US005653909A

United States Patent [19]

Muraki et al.

[11] Patent Number: 5,653,909

[45] Date of Patent: Aug. 5, 1997

[54] REFRIGERATING MACHINE OIL COMPOSITION FOR USE WITH HFC REFRIGERANT

[75] Inventors: Masayoshi Muraki; Yukiharu Beppu; Shozaburo Konishi, all of Kanagawa; Susumu Kawaguchi, Shizuoka; Noboru Masuda, Shizuoka; Sou Suzuki, Shizuoka, all of Japan

[73] Assignees: Mitsubishi Denki Kabushiki Kaisha; Mitsubishi Oil Company, Limited, both of Tokyo, Japan

[21] Appl. No.: 468,754

[22] Filed: Jun. 6, 1995

[30] Foreign Application Priority Data

Nov. 30, 1994 [JP] Japan ..... 6-319524

[51] Int. Cl.[6] ..... C10M 129/18; C10M 105/38; C09K 5/04

[52] U.S. Cl. ..... 252/68; 252/67; 508/304; 62/468

[58] Field of Search ..... 252/68, 67, 56 R, 252/56 S, 52 A; 508/304; 62/468

[56] References Cited

U.S. PATENT DOCUMENTS

| | | | |
|---|---|---|---|
| 4,431,557 | 2/1984 | Shimizu et al. | 252/68 |
| 4,944,663 | 7/1990 | Iizuka et al. | 418/178 |
| 5,202,044 | 4/1993 | Hagihara et al. | 252/68 |
| 5,279,752 | 1/1994 | Hasegawa et al. | 252/68 |
| 5,342,533 | 8/1994 | Kondo et al. | 252/68 |
| 5,403,372 | 4/1995 | Uchida | 75/236 |
| 5,445,753 | 8/1995 | Fukuda et al. | 252/52 R |
| 5,447,647 | 9/1995 | Ishida et al. | 252/68 |
| 5,454,963 | 10/1995 | Kaneko | 252/52 R |
| 5,464,550 | 11/1995 | Sasaki et al. | 252/68 |

FOREIGN PATENT DOCUMENTS

| | | |
|---|---|---|
| 0 496 937 | 8/1992 | European Pat. Off. . |
| 0 568 038 | 11/1993 | European Pat. Off. . |
| 0 612 835 | 8/1994 | European Pat. Off. . |
| 4-183791 | 6/1992 | Japan . |
| 4-359998 | 12/1992 | Japan . |
| 6-248285 | 9/1994 | Japan . |

OTHER PUBLICATIONS

Database WPI, Derwent Publications, AN 95–295266, JP–A–7 189 955, Jul. 28, 1995.

Database WPI, Derwent Publications, AN 87–133486, JP–A–62 075 083, Apr. 6, 1987.

*Primary Examiner*—Christine Skane

*Attorney, Agent, or Firm*—Oblon, Spivak, McClelland, Maier & Neustadt, P.C.

[57] ABSTRACT

A refrigerating machine oil composition suitable for a compressor using a hydrofluorocarbon as a refrigerant, which comprises 100 parts by weight of a polyol ester as a base oil, from 7.0 to 15.0 parts by weight of a phosphate, and from 0.2 to 3.0 parts by weight in total of a 1,2-epoxyalkane and/or a vinylcyclohexene dioxide. The use of the refrigerating machine oil composition improves wear resistance of sliding portions of compressors and is free from the formation of sludges derived from the polyol ester used as a base oil of the oil composition. A rotary compressor using the oil composition is also disclosed.

3 Claims, 2 Drawing Sheets

REFRIGERATING MACHINE OIL COMPOSITION FOR USE WITH HFC REFRIGERANT

FIELD OF THE INVENTION

The present invention relates to a refrigerating machine oil composition for a compressor using hydrofluorocarbon (HFC) as a refrigerant, and a compressor using the refrigerating machine oil composition. More specifically, it relates to a refrigerating machine oil composition which suppresses the formation of sludges, which is excellent in wear resistance, load carrying capacity, themal stability, chemical stability, low-temperature fluidity, and compatibility with a HFC refrigerant, and which can also be used for a rotary compressor which is used under severe conditions such as a high-temperature and high-pressure condition. The present invention also relates to a compressor having a sliding portion, particularly a rotary compressor, which contains the refrigerating machine oil composition.

BACKGROUND OF THE INVENTION

1. Required properties of refrigerating machine oil:

Typical type of compressor for refrigerators are a reciprocating type, a scroll type, and a rotary type. In these types, a rotary compressor is used under severe conditions, like a high-temperature and high-pressure condition.

Important properties that are generally taken into account for a refrigerating machine oil used in any types of compressors are wear resistance, load carrying capacity, thermal stability, chemical stability, low-temperature fluidity, and compatibility with a refrigerant.

The refrigerating machine oil is required to have functions of preventing wear of and cooling a sliding portion of the compressor, releasing heat generated upon compression of the refrigerant, sealing at a refrigerant-compressing step, and removing worn powders and foreign matters, etc.

Thus, the refrigerating machine oils having not only excellent lubricating properties (such as wear resistance, load carrying capacity, etc.,) but also high thermal and chemical stabilities in the compressor and giving no adverse influences on the machine parts (e.g., metals, etc.) of the compressor are desired.

Also, a part of the refrigerating machine oil is carried with a compressed refrigerant, circulates through the system of the refrigerator, and flows into low-temperature portions such as an evaporator, capillary tubes, expansion valves, etc. Thus, for increasing the cooling performance of the evaporator and improving recovery of the oil from the low-temperature portions to the compressor, or for supplying the oil to sliding portions of the compressor at a low temperature when resuming the operation, good low-temperature fluidity and good compatibility with the refrigerant are required for the refrigerating machine oil.

2. Relation of refrigerant and refrigerating machine oil:

Hitherto, as a refrigerant used in a compressor for a refrigerator, Flon series refrigerants such as a chlorofluorocarbon (CFC) series refrigerant and a hydrochlorofluorocarbon (HCFC) series refrigerant have been used independently or as a mixture thereof. These refrigerants have good compatibility with a non-polar hydrocarbon oil since they have a low polarity. Also, the Flon series refrigerants each has chlorine atoms in the molecule, so that the chlorine reacts with a material constituting the sliding surface of the compressor to form a chloride which acts as a lubricant. In addition, a hydrocarbon oil has a good lubricating property.

For the reasons, hydrocarbon oils such as properly refined naphthenic mineral oils, paraffinic mineral oils, alkyl benzenes, poly-α-olefines, etc., are used independently or as a mixture thereof as a base oil of a refrigerating machine oil for the refrigerator using the Flon series refrigerant, to which an antioxidant, an anti-wear agent, a corrosion inhibitor, etc., are generally added.

In this connection, a phosphate has a low solubility in a hydrocarbon oil and shows a wear resistance effect at a low concentration. Therefore, the phosphate is usually added to the base oil (hydrocarbon oil) in an amount of not more than 1% by weight.

After being reported that the ozone layer in the stratosphere is destroyed by Flon containing chlorine atoms, the regulation on use of the CFC series refrigerant and the HCFC series refrigerant becomes strict worldwide. Under the circumstance, intensive studies for the substitution thereof has been made, and various substitutes have been reported for the Flon series refrigerants (e.g., for HCFC-22 (R-22)), such as hydrofluorocarbon (HFC) series mixed refrigerants, e.g., HFC-134a, HFC-143a, HFC-125, HFC-32, etc.

However, since the HFC series refrigerants have a high polarity, they have poor compatibility with a hydrocarbon oil. Thus, a refrigerating machine oil suitable for the HFC series refrigerants has been desired.

3. Conventional techniques on refrigerating machine oils for HFC series refrigerants:

As a lubricating oil for a refrigerator using the HFC series refrigerant, synthetic oxygen-containing hydrocarbon oils having good compatibility with the HFC series refrigerants, such as ester series synthetic oils, polyether series synthetic oils, etc., have been known. Among these synthetic oils, the ester series synthetic oils have high electric insulating property, good compatibility at a high-temperature and low hygroscopic property, as compared with the polyether series synthetic oils.

There have been known refrigerating machine oils composed of a ester series synthetic oil, as disclosed in, for example, JP-A-56-133241 and JP-A-59-164393 (the term "JP-A" as used herein means an "unexamined published Japanese patent application"); refrigerating machine oils to be used with a chlorinated fluorinated hydrocarbon or a fluorinated hydrocarbon for the refrigerant, as disclosed in JP-A-2-276894; and refrigerating machine oils to be used with a hydrogen-containing Flon, as disclosed in JP-A-3-88892, JP-A-3-128991, and JP-A-3-128992.

Also, refrigerating machine oils comprising an ester series synthetic oil and a phosphate or a phosphite are disclosed in JP-A-55-92799, JP-A-56-36570, JP-A-56-125494, JP-A-62-156198, JP-A-3-24197, and JP-A-5-59388, and oils for a heat pump are disclosed in JP-B-57-43593 (the term "JP-B" as used herein means an "examined Japanese patent application").

In particular, the foregoing refrigerating machine oil disclosed in JP-A-5-59388, which is also applicated in U.S. and issued as U.S. Pat. No. 5,342,533, is for a refrigerator using the HFC series refrigerant and consists essentially of 100 parts by weight of a dibasic acid diester or a carboxylate of a polyhydric alcohol as a base oil, and from 5.0 to 90.0 parts by weight of a phosphate or a phosphite.

Furthermore, refrigerating machine oils containing a thiophosphite, an epoxy compound and a methanesulfonate are disclosed in JP-A-56-36569, JP-A-58-15592, and JP-A-62-292895. Also, refrigerating machine oils comprising an ester oil, an alkylbenzene, or a mineral oil as a base oil and an alkylene glycol glycidyl ether or an aliphatic cyclic epoxy compound having a specific structure are disclosed in JP-A-5-17792.

A polyol ester (an ester series synthetic oil) exhibits excellent electric insulating property, compatibility with the HFC series refrigerant at a high-temperature, and a low hygroscopic property, and hence the polyol ester is preferable for the refrigerator using the HFC series refrigerant.

However, since the polyol ester is chemically active as compared with a hydrocarbon oil, the polyol ester is liable to form a sludge in a compressor at a high temperature. Also, since the HFC series refrigerant does not have a chlorine atom in the molecule, the lubricating property becomes insufficient sometimes in the case of using a compressor under severe conditions. Hitherto, efforts have been made to improve a wear resistance and a thermal stability by way of additives, but satisfactory additives enabling suppression of a sludge formation and a prevention of wear each being the problems encountered in use of the ester series synthetic oils, has not yet been developed.

In particular, a rotary compressor is used under severe conditions as compared with the case where a reciprocating compressor or a scroll compressor is used, and hence the refrigerating machine oil used in the rotary compressor is required to have a higher wear resistance and a higher thermal stability simultaneously. Thus, for the refrigerator equipped with a rotary compressor, it is considered to be difficult to use a polyol ester, and hence the improvement of the inside parts of the compressor has been attempted.

SUMMARY OF THE INVENTION

An object of the present invention is to provide a refrigerating machine oil having good properties with respect to wear resistance, anti-load carrying capacity, good compatibility, etc., as a lubricating oil for a compressor of a refrigerator using the HFC series refrigerant and being capable of using for a long period of time while suppressing the formation of sludges.

Another object of the present invention is to provide a rotary compressor having a sliding portion, particularly an improved vane portion, wherein the above-mentioned refrigerating machine oil is used.

As the result of various studies for achieving the foregoing objects, the present inventors have searched for additives suitable for polyol ester from various kinds of additives and discovered suitable combination with the polyol ester and the optimum composition ratio of the polyol ester-based refrigerating machine oil, whereby the inventors have succeeded in developing a refrigerating machine oil suitable for a rotary compressor, to which application of the polyol ester as the base oil has hitherto been considered difficult. Further, an improvement of a compressor has been attained to enhance the effect of the refrigerating machine oil of the present invention.

That is, according to the present invention, there is provided a refrigerating machine oil composition for a compressor using a hydrofluorocarbon as a refrigerant, which comprises (i) 100 parts by weight of a polyol ester as a base oil, (ii) from 7.0 to 15.0 parts by weight of a phosphate, and (iii) from 0.2 to 3.0 parts by weight in total of a 1,2-epoxyalkane and/or a vinylcyclohexene dioxide.

The refrigerating machine oil composition of the present invention can be used in any types of compressor having a sliding portion and using a hydrofluorocarbon as a refrigerant. In the case of a rotary compressor using the refrigerant, vane portions of which is preferably subjected to a nitriding treatment, whereby the effect of the refrigerating machine oil composition can be enhanced.

DETAILED DESCRIPTION OF THE INVENTION

Figure 1:
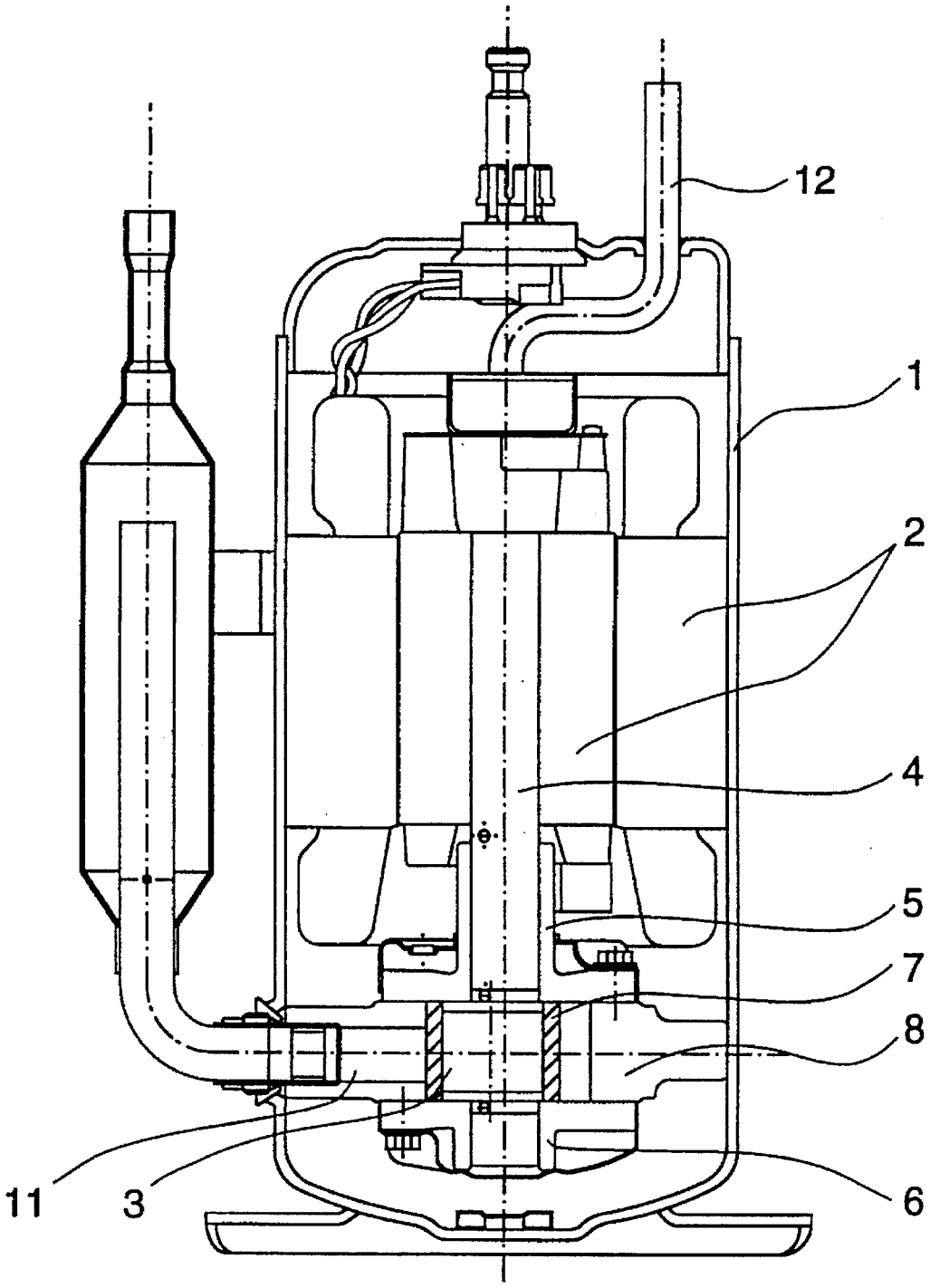
FIG. 1 is a vertical section of a rotary compressor used in the Examples.

In the present invention, a polyol ester is used as a base oil of the refrigerating machine oil composition.

The polyol esters which can be used in this invention are those obtained by reacting at least one polyhydric alcohol (e.g., neopentyl glycol, trimethylolpropane, pentaerythritol, and dipentaerythritol) with at least one of carboxylic acids (e.g., straight chain saturated fatty acids such as acetic acid, propanoic acid, butanoic acid, pentanoic acid, hexanoic acid, heptanoic acid, octanoic acid, nonanoic acid, decanoic acid, undecanoic acid, dodecanoic acid, etc.; monoalkyl branched fatty acids such as isobutanoic acid, 2-methylbutanoic acid, isopentanoic acid, trimethylpropanoic acid, 2-methylpentanoic acid, 3-methylpentanoic acid, 4-isocaproic acid, 8-ethylhexanoic acid, 4-propylpentanoic acid, 4-ethylpentanoic acid, 2-methyldecanoic acid, 3-methyldecanoic acid, 4-methyldecanoic acid, 5-methyldecanoic acid, 6-methyldecanoic acid, 6-ethylnonanoic acid, 5-propyloctanoic acid, 3-methylundecanoic acid, 6-propylnonanoic acid, etc.; and polyalkyl branched fatty acids such as 2,2-dimethylbutanoic acid, 2,2-dimethylpentanoic acid, 2,2,3-trimethylbutanoic acid, 2,2-dimethylhexanoic acid, 2-methyl-3-ethylpentanoic acid, 2,2,3-trimethylpentanoic acid, 2,2-dimethylheptanoic acid, 2-methyl-3-ethylhexanoic acid, 2,2,4-trimethylhexanoic acid, 2,2-dimethyl-3-ethylpentanoic acid, 2,2,3-trimethylpentanoic acid, 2,2-dimethyloctanoic acid, 2-butyl-5-methylpentanoic acid, 2-isobutyl-5-methylpentanoic acid, 2,3-dimethylnonanoic acid, 4,8-dimethylnonanoic acid, 2-butyl-5-methylhexanoic acid, etc.). The polyol esters may be used independently or as a mixture thereof.

The polyol ester used in this invention generally has a viscosity of from 5 to 150 $mm^2/s$ (40° C.), an acid value of up to 1 mg KOH/g and a water content of up to 500 ppm. It is preferred that the polyol ester be distilled, filtered and treated with an adsorbent or a dewatering agent, before use for removing impurities, foreign substances and water that give adverse influences on the thermal stability of the refrigerating machine oil. The polyol ester preferably has an acid value of not higher than 0.01 mg KOH/g and a water content of not more than 100 ppm.

Naphthenic mineral oils, paraffinic mineral oils, alkylbenzenes, and poly-α-olefines, which has been used for the Flon series refrigerant, cannot be used as the base oil of the refrigerating machine oil composition of the present invention because they have poor compatibility with the HFC series refrigerant.

In the present invention, a phosphate is used as an essentional component. Examples of the phosphate, include trimethyl phosphate, triethyl phosphate, tributyl phosphate, trioctyl phosphate, tributoxyethyl phosphate, triphenyl phosphate, tricresyl phosphate, trixylenyl phosphate, cresyldiphenyl phosphate, diphenylorthoxenyl phosphate, octyldiphenyl phosphate, phenylisopropylphenyl phosphate, diphenylisopropylphenyl phosphate, tris(isopropylphenyl) phosphate, tris(chloroethyl) phosphate, and trisdichloropropyl phosphate. Of these tricresyl phosphate, phenylisopropylphenyl phosphate, diphenylisopropylphenyl phosphate, and tris(isopropylphenyl) phosphate are particularly preferred. However, the present invention is not limited to these phosphates.

The phosphate is contained in the oil composition in an amount of from 7.0 to 15.0% by weight based on the amount of the base oil (i.e., polyol ester). The phosphate improves the wear resistance. If the amount of the phosphate is less than 7.0% by weight or over 15.0% by weight, the wear resistance is lowered.

In the case of the combination of the conventionally used HCFC series refrigerant and an alkylbenzene series refrigerating machine oil, it has been confirmed that the addition of a phosphate as an extreme pressure agent in the refrigerating machine oil results in the formation of iron phosphate by adsorbing on and reacting with a material (Fe) of the sliding surface of a compressor and also the formation of chlorides by reacting chlorine atoms contained in the HCFC series refrigerant on the sliding surface, whereby the wear resistance is enhanced. On the other hand, the HFC series refrigerant as used in the present invention does not contain chlorine atoms, and the wear resistance is low. As a result of intensive studies made by the inventors, it has been found that there is an optimum amount of the phosphate with respect to the polyol ester for attaining an enhanced wear resistance, that is, about 7 times to 15 times of the amount of a phosphate with respect to the alkylbenzene series refrigerating machine oil used for the HCFC series refrigerant.

In the present invention, a 1,2-epoxyalkane and/or a vinylcyclohexene dioxide are also added as components of the refrigerating machine oil composition. These may be used independently or as a mixture thereof. Examples of the 1,2-epoxyalkane include 1,2-epoxyhexane, 1,2-epoxyheptane, 1,2-epoxyoctane, 1,2-epoxydecane, 1,2-epoxyundecane, 1,2-epoxydodecane, 1,2-epoxytridecane, 1,2-epoxytetradecane, 1,2-epoxyhexadecane, 1,2-epoxyheptadecane, and 1,2-epoxyoctadecane. However, the present invention is not limited thereto. The vinylcyclohexene dioxide includes various isomers, and a typical example thereof has the following structural formula:

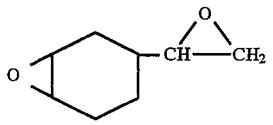

The total amount of the 1,2-epoxyalkane and/or the vinylcyclohexene dioxide is from 0.2 to 3.0% by weight based on the amount of the base oil (i.e., polyol ester). If it is less than 0.2% by weight or over 3.0% by weight, sludges may be formed depending upon the type of compressor used and the operation condition.

The 1,2-epoxyalkane and the vinylcyclohexene dioxide have a function of suppressing the formation of sludges encounted in use of a polyol ester as a base oil. Though it is not desired to be bound, the mechanism of the formation of sludges is explained as follows.

That is, a polyol ester is liable to cause a hydrolysis when water is contained thereto in a high-temperature and high-pressure state. By the hydrolysis, the polyol ester is decomposed into an alcohol and an acid which reacts with a material of parts (such as the sliding part) of a compressor to corrode the parts, in turn, forming sludges. Also, since a polyol ester is chemically active as compared to a hydrocarbon oil, the polyol ester tends to be modified at a high temperature, forming sludges. The 1,2-epoxyalkane and the vinylcyclohexene dioxide prevent the hydrolysis and the modification of the polyol ester.

Incidentally, phenyl glycidyl ether is classified into an epoxy compound as well as the 1,2-epoxyalkane and the vinylcyclohexene dioxide, but does not have the function of suppressing the formation of sludges.

In the case of a compressor which can be used without strict control of the formation of sludges, however, the 1,2-epoxyalkane and the vinylcyclohexene dioxide need not be added as long as the foregoing phosphate is added in an amount of 7.0 to 15.0% by weight based on the amount of base oil (i.e., polyol ester).

The refrigerating machine oil composition of the present invention can contain an antioxidant, a metal deactivator, a defoaming agent, etc., usually used as additives for a conventional refrigerating machine oil.

As the antioxidant which can be used in the present invention, there are hindered phenol series antioxidants, amine series antioxidants, sulfur series antioxidants, etc., such as, for example, 2,6-di-t-butyl-4-methylphenol, 4,4'-methylenebis(2,6-di-t-butylphenol), 2,2'-thiobis(4-methyl-6-t-butylphenol), trimethyldihydroquinone, p,p'-dioctyldiphenylamine, 3,7-dioctylphenothiazine, an alkylphenothiazine-1-carboxylate, phenyl-2-naphthylamine, 2,6-di-t-butyl-2-dimethyl-p-cresol, 5-ethyl-10,10'-diphenylphenazarine, and an alkyl disulfide. Examples of the metal deactivator include alizanin, quilizanin, benzotriazole, and mercaptobenzotriazole. Examples of the defoaming agent, include dimethylpolysiloxane and metal carboxylates.

Figure 2:
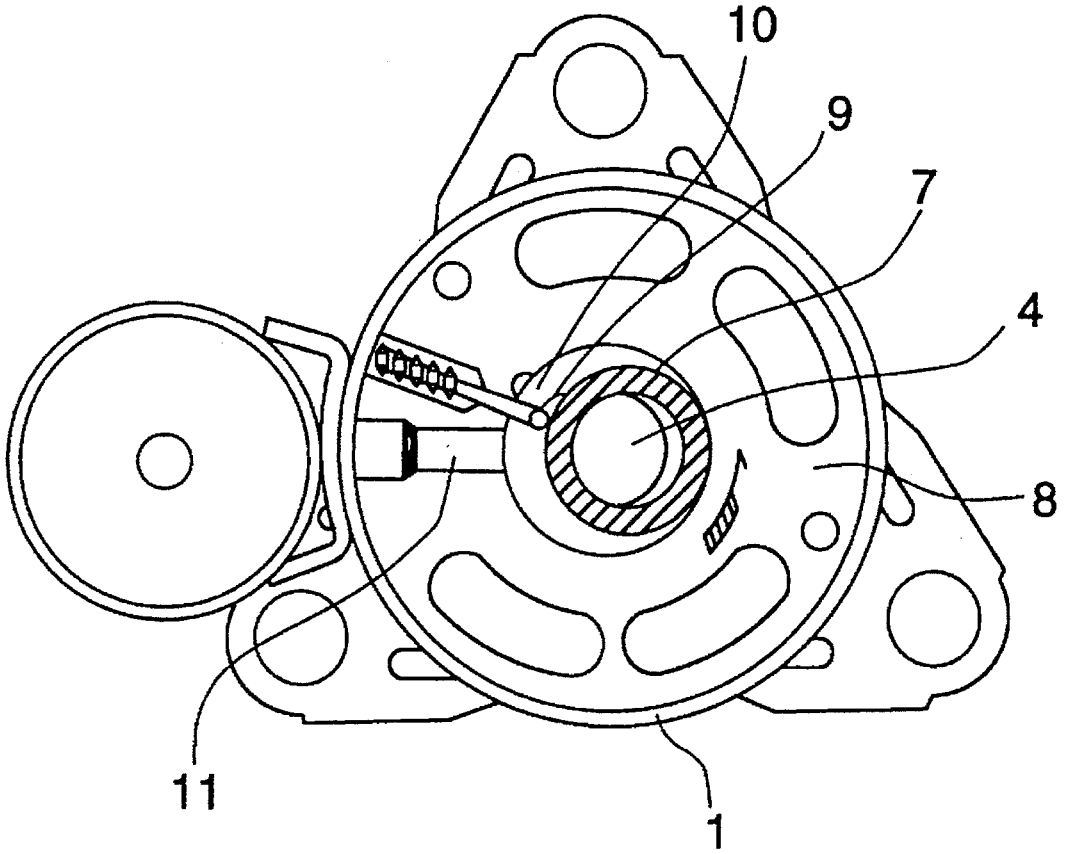
FIG. 2 is a cross section of the rotary compressor used in the Examples.

The refrigerating machine oil composition of the present invention can be used in any types of compressors having a sliding portion (such as a rotary compressor, a reciprocating compressor, and a scroll compressor) and using a hydrofluorocarbon as a refrigerant. According to a preferred embodiment of the present invention, the oil composition is used in a rotary compressor as conventionally used in a refrigerator. A typical rotary compressor is illustrated in FIGS. 1 and 2 which are vertical section and a cross section, respectively, of the rotary compressor.

The rotary compressor is explained with reference to FIGS. 1 and 2 below. In shielded container 1, motor portion 2 is provided, and clank shaft 4 having eccentric portion 3 driven by motor portion 2 is supported by main bearing 5 and sub bearing 6. Cylindrical rolling piston 7 which is mounted at eccentric portion 3 of clank shaft 4 is rolled eccentrically in cylinder 8 in which vane 9 is kept in contact with rolling piston 7 to provide compression chamber 10. By the eccentric movement of rolling piston 7 due to rotation of motor portion 2, the thus constructed rotary compressor sucks a refrigerant from intake hole 11, compresses and discharges in shielded container 1, and the compressed refrigerant is discharged through discharge tube 12 into a cooling pass.

The vane portion of the compressor which is driven under extremely severe conditions is preferably made of an iron-based material containing Cr and subjected to a nitriding treatment, whereby wear resistance and load carrying capacity are further enhanced. The nitriding treatment can be conducted by placing the vane material in a vacuum chamber, to which a nitriding accelerator gas mainly composed of $NH_3$ gas is introduced to treat the vane material, whereby a diffusion layer of high wear resistance is formed on the surface of the vane, instead of a brittle white layer (epsilon layer).

EXAMPLES

The present invention will be explained in detail below, with reference to the following Examples and Comparative Examples. The base oils, the additives, and the test method used in the Examples and the Comparative Examples and the test results are as follows.

1. Base oil:

(1) Examples and Comparative Examples 1 to 9, 11, and 12

Polyol esters each having an acid value of not higher than 0.01 mg KOH/g and a water content of not more than 100 ppm, synthesized by reacting pentaerythritol and a mixture of branched fatty acids having 7, 8, and 9 carbon atoms (2-methylhexanoic acid and 2-ethylpentanoic acid for the $C_7$-fatty acids; 2-ethylhexanoic acid for the $C_8$-fatty acid; and 3,5,5-trimethylhexanoic acid for the $C_9$-fatty acid) were used.

(2) Comparative Example 10

An alkylbenzene ("ABA-H", trade name of hard-type alkylbenzene, manufactured by Mitsubishi Chemical Corporation) was used.

The alkylbenzene is usually used as a base oil of a refrigerating machine oil for a refrigerator using HCFC-22 refrigerant.

2. Additive:

As a phosphate, tricresyl phosphate was used.

As an epoxy compound, vinylcylohexene dioxide was used in Examples 1 to 5, Comparative Examples 2, 4 to 7, 11, and 12, and 1,2-epoxyalkane (a mixture of 1,2-epoxydodecane, 1,2-epoxytridecane and 1,2-epoxytetradecane) was used in Example 6.

In Comparative Examples 8 and 9, phenyl glycidyl ether was used as an epoxy compound.

The composition ratios thereof based on the amount of the base oil are shown in Table 1 and 2 below.

3. Test method:

(1) Falex test (wear test):

In the atmosphere of HFC-134a or HCFC-22 refrigerant, an wear test was carried out at a temperature of 100° C. and an atmospheric gas pressure of 600 kPa for one hour using a steel ring and a steel block as test materials by the Falex test (ASTM D2714), and an wear volume of the surface of the steel block after testing was measured.

(2) Shield tube test method (thermal and chemical stability test):

In the atmosphere of HFC-134a or HCFC-22 refrigerant, a thermal and chemical stability tests were carried out by a shield tube test method, wherein the refrigerant, a test oil, Fe, Cu, and Al wires were placed in a glass vessel of about 1 c.c., followed by heating at 175° C. for 14 days and examining whether or not changing of the color of the test oil and formation of slidges occur.

4. Test result:

The results of the Falex test and the shield tube test are shown Table 1 below. The Falex test results are relative values, taking the wear volume in Comparative Example 10 (wherein the refrigerant was HCFC-22 and the base oil was alkylbenzene) as being 1.0.

TABLE 1

| Composition and | Example | | | | | |
|---|---|---|---|---|---|---|
| Test Result | 1 | 2 | 3 | 4 | 5 | 6 |
| Refrigerant | HFC-134a | | | | | |
| Base Oil | Polyol Ester | | | | | |
| Additives (wt. %)* | | | | | | |
| Phosphate | 7.0 | 10.0 | 15.0 | 10.0 | 10.0 | 10.0 |
| Epoxy compound | | | | | | |
| Vinylcyclohexene dioxide | 1.0 | 1.0 | 1.0 | 0.2 | 3.0 | — |
| 1,2-Epoxyalkane | — | — | — | — | — | 1.0 |
| Falex Test (wear volume ratio) | 0.9 | 0.5 | 0.8 | 0.5 | 0.5 | 0.5 |
| Shield Tube Test (sludge formation) | none | none | none | none | none | none |

| Composition and | Comparative Example | | | | | |
|---|---|---|---|---|---|---|
| Test Result | 1 | 2 | 3 | 4 | 5 | 6 |
| Refrigerant | HFC-134a | | | | | |
| Base Oil | Polyol Ester | | | | | |
| Additive (wt %) | | | | | | |
| Phosphate Epoxy Compound | — | — | 10.0 | 6.0 | 16.0 | 10.0 |
| Vinyl-cyclohexene dioxide | — | 1.0 | — | 1.0 | 1.0 | 0.1 |
| Falex Test (wear volume ratio) | 4.0 | 4.0 | 0.5 | 1.6 | 1.3 | 0.5 |
| Shield Tube Test (sludge formation) | observed | none | observed | none | none | observed |

| Composition and | Comparative Example | | | |
|---|---|---|---|---|
| Test Result | 7 | 8 | 9 | 10 |
| Refrigerant | HFC-134a | | | HCFC-22 |
| Base Oil | Polyol Ester | | | Alkylbenzene |
| Additives (wt %) | | | | |
| Phosphate Epoxy Compound | 10.0 | 10.0 | 10.0 | 0.5 |
| Vinylcyclohexene dioxide | 3.1 | — | — | — |
| Phenyl glycidyl ether | — | 0.5 | 1.0 | — |
| Falex Test (wear volume ratio) | 0.5 | 0.5 | 0.5 | 1.0 |
| Shield Tube Test (sludge formation) | observed | observed | observed | none |

Note: *based on the amount of the base oil (hereafter the same)

(1) Examples 1 to 6 and Comparative Example 10:

In all the samples in the examples of this invention, the wear resistance was better than the sample in Comparative Example 10 (the composition of a conventional technique) using HCFC-22 refrigerant, and even when HFC-134a refrigerant was used, sludges (results by the use of a polyol ester) were not formed.

(2) Comparative Examples 1 to 3, 8, and 9:

In the sample of Comparative Example 1, which was not compounded with the epoxy compound of the present invention and a phosphate, the wear resistance and the thermal and chemical stability were poor, and sludges were formed.

In the sample of Comparative Example 2, which was not compounded with a phosphate, the wear resistance was poor.

In the sample of Comparative Example 3, which was not compounded with the epoxy compound of the present invention, sludges were formed.

In the samples of Comparative Examples 8 and 9, which were compounded with phenyl glycidyl ether in place of the epoxy compound of the present invention, the surface of the Fe wire was blackened in the shield tube test, and sludges were markedly formed.

It can be seen from the above results that for achieving the object of the present invention, the epoxy compound of the present invention and the phosphate are indispensable factors.

(3) Comparative Examples 4 and 5:

In the samples of Comparative Examples 4 and 5, wherein the amount of the phosphate is outside the range of from 7.0 to 15.0% by weight defined in the present invention, the wear resistance is inferior to those of the samples of Examples 1 to 3, and 6 and the sample of Comparative Example 10.

From the results, it can be seen that the optimum amount of the phosphate is from 7.0 to 15.0% by weight for achieving the object of the present invention.

(4) Comparative Examples 6 and 7:

In the samples of Comparative Examples 6 and 7, wherein the amount of the epoxy compound of the present invention is outside the range of from 0.2 to 3.0% by weight defined in the present invention, sludges were formed.

Thus, it can be seen that the optimum amount of the epoxy compound of the present invention for achieving the object of the present invention is from 0.2 to 3.0% by weight.

5. Actual Test and Test Result:

(1) Accelerated durability tests of scroll compressor and rotary compressor:

By using HFC-134a refrigerant in Example 2 and Comparative Examples 11 and 12 and by using HCFC-22 refrigerant in Comparative Example 10, an accelerated durability test of a scroll compressor or a rotary compressor was performed for 2,000 hours. Thereafter, the compressor was disintegrated and the worn state of the sliding portion was observed. In the test using the rotary compressor, the compressor having the surface of vane portion subjected to a nitriding treatment and the compressor having the vane portion without the nitriding treatment were used.

The test results are shown in Table 2 below.

TABLE 2

| Composition and | Example | Comparative Example | | |
|---|---|---|---|---|
| Test Result | 2 | 11 | 12 | 10 |
| Refrigerant | | HFC-134a | | HCFC-22 |
| Base Oil | | Polyol Ester | | Alkylbenzene |
| Additives (wt. %) | | | | |
| Phosphate | 10.0 | 5.0 | 20.0 | 0.5 |
| Epoxy Compound | | | | |
| Vinylcyclohexene dioxide | 1.0 | 1.0 | 1.0 | — |
| Scroll type compressor acceleration duarability test (worn state of the sliding portion) | small | medium | medium | small |
| Rotary type compressor acceleration durability test (worn state of vane portion) | | | | |
| Vane portion nitrided | small | scuff-ing | scuff-ing | small |
| Vane portion not nitrided | medium | | | small |

In Comparative Example 11 (the amount of the phosphate was 5.0% by weight) and Comparative Example 12 (the amount of the phosphate was 20.0% by weight), the wear amount of the sliding portion of the scroll type compressor was larger than those in Example 2 and Comparative Example 10. The results coincides with the Falex test results as shown in Table 1.

In Comparative Examples 11 and 12, scuffing occurred at the vane portion even when subjected to a nitriding treatment, and the wear resistance was poor.

On the other hand, in Example 2, the wear resistance was better in the case of subjecting the vane portion to a nitriding treatment than the case of not subjecting the vane portion to a nitriding treatment.

Thus, it has been confirmed that in the rotary compressor operated under severe conditions, the effect of the present invention can be enhanced by the nitriding treatment of the vane portion thereof.

As described above, the present invention is a refrigerating machine oil composition for compressor using HFC-134a refrigerant and other HFC series refrigerants which have been proposed as the substitute of the HCFC series refrigerants.

The present invention of the refrigerating machine oil composition consists essentially of a polyol ester as a base oil and phosphate and specific epoxy compound (i.e., 1,2-epoxyalkane and/or vinylcyclohexene dioxide) as additives.

Further, this invention is characterized each of above mentioned additives to be contained in the base oil with a specific range of amount.

According to the present invention, the problems of insufficiency of the wear resistance and the formation of sludges, which are the problems encountered in the case of using a polyol ester, are solved while enjoying advantageous properties of the polyol ester (ester series synthetic. oil) such as the electric insulating property, the compatibility with the HFC refrigerant, the low hygroscopic property, by compounding the polyol ester with a phosphate as an extreme pressure agent or anti-wear agent, and further a 1,2-epoxyalkane and/or a vinylcyclohexene dioxide as a hydrolysis preventing agent in optimum amounts.

By using the refrigerating machine oil composition of the present invention, wear at the sliding portions of various compressors can be minimized, so that reliability of the compressors can be increased. Further, in combination with the nitriding treatment of vane portion which is a sliding portion of rotary compressor driven under extremely severe conditions, wear of the vane portion can be further minimized, and in turn enhancing the reliability of rotary compressor.

While the invention has been described in detail and with reference to specific embodiments thereof, it will be apparent to one skilled in the art that various changes and modification can be made therein without departing from the spirit and scope thereof.

What is claimed is:

1. A refrigerating machine oil composition for a compressor using a hydrofluorocarbon as a refrigerant, which comprises (i) 100 parts by weight of a carboxylate of pentaerythritol and/or a carboxylate of dipentaerythritol as a base oil, (ii) from 7.0 to 15.0 parts by weight of a phosphate, and (iii) from 0.2 to 3.0 parts by weight in total of a vinylcyclohexene dioxide.

2. A compressor having a sliding portion and having introduced therein a hydrofluorocarbon as a refrigerant and a refrigerating machine oil composition comprising (i) 100 parts by weight of a carboxylate of pentaerythritol and/or a carboxylate of dipentaerythritol as a base oil, (ii) from 7.0 to 15.0 parts by weight of a phosphate, and (iii) from 0.2 to 3.0 parts by weight in total of a vinylcyclohexene dioxide.

3. The compressor as in claim 2, which is a rotary compressor having a vane portion the surface of which is subjected to a nitriding treatment.

* * * * *